US009605489B2

(12) United States Patent
Van Staden et al.

(10) Patent No.: US 9,605,489 B2
(45) Date of Patent: Mar. 28, 2017

(54) COMPOSITE PART INCLUDING A CUTTING ELEMENT

(75) Inventors: Louise Frances Van Staden, Ebotse (ZA); Klaus Tank, Johannesburg (ZA)

(73) Assignee: Element Six Abrasives S.A., Luxembourg (LU)

( * ) Notice: Subject to any disclaimer, the term of this patent is extended or adjusted under 35 U.S.C. 154(b) by 712 days.

(21) Appl. No.: 13/994,141

(22) PCT Filed: Dec. 19, 2011

(86) PCT No.: PCT/EP2011/073277

§ 371 (c)(1),
(2), (4) Date: Sep. 26, 2013

(87) PCT Pub. No.: WO2012/084850

PCT Pub. Date: Jun. 28, 2012

(65) Prior Publication Data

US 2014/0007519 A1 Jan. 9, 2014

Related U.S. Application Data

(60) Provisional application No. 61/425,965, filed on Dec. 22, 2010.

(30) Foreign Application Priority Data

Dec. 22, 2010 (GB) ..... 1021741.2

(51) Int. Cl.
*E21B 10/56* (2006.01)
*E21B 10/573* (2006.01)

(52) U.S. Cl.
CPC ..... *E21B 10/5735* (2013.01); *E21B 10/573* (2013.01)

(58) Field of Classification Search
CPC ..... C22C 1/002; E21B 10/5676; B24D 3/10
See application file for complete search history.

(56) References Cited

U.S. PATENT DOCUMENTS 5,116,568 A 5/1992 Sung et al.
5,127,923 A * 7/1992 Bunting ..... B24D 3/007 51/293

(Continued)

FOREIGN PATENT DOCUMENTS

JP 2010023146 2/2010
JP 2010112120 5/2010

(Continued)

OTHER PUBLICATIONS

International Patent Application No. PCT/EP2011/073277, International Search Report and Written Opinion issued May 23, 2013, 10 pages.

(Continued)

*Primary Examiner* — Will Fridie, Jr.
(74) *Attorney, Agent, or Firm* — Dean W. Russell; Clark F. Weight; Kilpatrick Townsend & Stockton LLP

(57) ABSTRACT

A composite part comprises (a) a cutting element which comprises super-hard cutting table and a substrate and (b) a metal or alloy layer. Respective first surfaces of the super-hard cutting table and the substrate are joined to each other, and the metal or alloy layer is located adjacent to second surfaces of the cutting table and the substrate so as to surround the joined first surfaces of the cutting table and the substrate. The metal or alloy layer and the second surfaces of one or both of the cutting table and substrate are co-operatively shaped substantially to prevent relative movement therebetween. The metal or alloy layer may be used to secure the cutting element within a tool body, and advantageously provides a convenient means to effect that securement, while simultaneously protecting the join between the (Continued)

superhard cutting table and the substrate during the process of securement of the cutting element to the tool body.

16 Claims, 3 Drawing Sheets

(56) References Cited

U.S. PATENT DOCUMENTS 5,355,750 A * 10/1994 Scott ..... B22F 7/06 419/9
7,909,121 B2 * 3/2011 Voronin ..... E21B 10/573 175/426
8,061,454 B2 * 11/2011 Voronin ..... B22F 7/062 175/426
8,727,043 B2 * 5/2014 Zhang ..... E21B 10/573 175/413
8,757,299 B2 * 6/2014 DiGiovanni ..... C22C 26/00 175/428
8,978,788 B2 * 3/2015 Vempati ..... C22C 26/00 175/426
9,217,296 B2 * 12/2015 Voronin ..... C22C 1/002
2009/0173014 A1 7/2009 Voronin et al.
2009/0173548 A1 7/2009 Voronin et al.
2010/0314176 A1 12/2010 Zhang et al.

FOREIGN PATENT DOCUMENTS

WO 2011005996 A2 1/2011
WO 2011038263 A2 3/2011

OTHER PUBLICATIONS

International Patent Application No. PCT/EP2011/073277, International Preliminary Report on Patentability issued Jun. 25, 2013, 7 pages.

* cited by examiner

COMPOSITE PART INCLUDING A CUTTING ELEMENT

CROSS REFERENCE TO RELATED APPLICATIONS

This application is the U.S. national phase of International Application No. PCT/EP2011/073277 filed on Dec. 19, 2011, and published in English on Jun. 28, 2012 as International Publication No. WO 2012/084850 A2, which application claims priority to Great Britain Patent Application No. 1021741.2 filed on Dec. 22, 2010, and U.S. Provisional Application No. 61/425,965 filed on Dec. 22, 2010, the contents of all of which are incorporated herein by reference.

FIELD

This disclosure relates generally to a composite part which includes a cutting element comprising a super-hard cutting table secured to a substrate. Some embodiments relate to structural features of the composite part for protecting the direct or indirect join between the super-hard cutting table and the substrate. Other embodiments relate to methods of protecting the join between the super-hard cutting table and the substrate, and to methods of securing the cutting element into a tool body.

BACKGROUND

Cutting elements comprising superhard cutting tables are used extensively in cutting, milling, grinding, drilling and other abrasive operations. For example, such cutting elements are widely used within drill bits used for boring into the earth in the oil and gas drilling industry.

Superhard cutting tables typically consist of a mass of superhard particles, typically diamond or cubic boron nitride, bonded into a coherent, polycrystalline conglomerate. As an example, polycrystalline diamond (PCD) is a super-hard material comprising a mass of inter-grown diamond grains and interstices between the diamond grains. PCD is typically made by subjecting an aggregated mass of diamond grains to an ultra-high pressure and temperature. Material wholly or partly filling the interstices is referred to as filler or binder material. PCD is typically formed in the presence of a sintering aid, which promotes the inter-growth of diamond grains. The sintering aid is commonly referred to as a solvent/catalyst material for diamond, owing to its function of dissolving diamond to some extent and catalysing its re-precipitation. A solvent/catalyst for diamond is understood to be a material capable of promoting the growth of diamond and the formation of direct diamond-to-diamond bonds at a temperature and pressure at which diamond is thermodynamically stable. As examples of solvent/catalyst materials there may be mentioned cobalt, iron, nickel, and manganese, and alloys including one or more of these materials. Consequently, the interstices within the sintered PCD product are typically wholly or partially filled with residual solvent/catalyst material.

It is common for superhard cutting tables to be supported on a support or substrate of some kind. For example it is known for superhard cutting tables to be supported on a cemented carbide substrate or support. This substrate provides a convenient means for attachment of cutting element comprising the cutting table and substrate within a tool body. It may also advantageously provide support in cases where the superhard cutting table is brittle. A typical cutting element incorporating a superhard cutting table comprises a disc shaped cutting table, for example a disc shaped PCD table, on a generally cylindrical substrate, e.g. a generally cylindrical cemented carbide substrate, e.g. tungsten carbide substrate. The substrate may have the same or similar diameter to the disc-shaped cutting element. The cemented carbide substrate may itself contain a binder material, for example cobalt, nickel, iron, manganese, or an alloy of one or more of these materials.

The term cutting "table" is used extensively in the field. While the structure of such a table in the field is commonly a substantially flat disc, no particular shape is required for the cutting "table", other than that of a shape capable of providing a surface which can apply a cutting or abrasive action.

Superhard cutting tables are often produced by placing the components necessary to form the cutting table in particulate form on a substrate in a reaction capsule, which is then placed in the reaction zone of a high pressure/high temperature apparatus, and subjected to high pressure and high temperature (HPHT). For example superhard particles, e.g. diamond particles, may be placed in combination with solvent/catalyst particles, e.g. cobalt, on a substrate, e.g. a cemented tungsten carbide substrate, in such a capsule, and subjected to HPHT. During the HPHT treatment, the catalyst/solvent material particles in the component mix, and/or also any binder materials present in the cemented carbide substrate, e.g. cobalt or the like, may migrate through and/or into the mass of superhard particles to act as a catalyst, these catalyst/solvent materials causing the ultrahard particles to bond to one another. Once manufactured the cutting element comprises a cemented carbide layer and a cutting "table" layer, the latter comprising a coherent matrix of superhard particles (e.g. diamond particles) bonded to one another with interstices containing binder material between those superhard particles. The production of cutting tables supported on a substrate in this way is described in many references, for example, in WO 2008/015622, US 2006/0060391, and U.S. Pat. No. 7,533,740.

It is also known in the art, e.g. from WO 2008/015622, that increased presence of solvent/catalyst material in the superhard element can compromise the thermal stability of the cutting element. Treatments to mitigate this are known. For example US 2006/0060391 describes treatment of a PCD body by removing substantially all of the catalyst material from a selected region of the body by a suitable process, e.g. acid leaching, aqua regia bath, electrolytic process, or combinations thereof.

It is also noted in US 2006/060391 that a PCD body can be formed with or without having a substrate material bonded to it.

WO2010/117834 and U.S. Pat. No. 7,533,740 are examples of references which describe securement of preformed thermally stable diamond cutting tables to substrates.

In use, for example in a drill bit or the like, the cutting table and substrate combination are frequently installed into sockets in, for example, blades forming a lower face of a bit body. This is described for example in US 2008/0185189. The cutting elements are typically brazed in place in the sockets.

SUMMARY

Viewed from one aspect there is provided a composite part comprising a super-hard cutting table, a substrate and a metal or alloy layer; the superhard cutting table having a first surface that is joined to a first surface of the substrate and the metal or alloy layer being located adjacent to second surfaces of the cutting table and the substrate so as to surround the join between the first surfaces of the cutting table and the substrate; (i) the metal or alloy layer and (ii) one or both of the second surfaces of the cutting table and substrate to which it is adjacent, being co-operatively shaped substantially to prevent relative movement therebetween.

Viewed from another aspect there is provided a method of protecting a join between a super-hard cutting table and a substrate using a metal or alloy layer, the method comprising: (i) forming one or more depressions and/or projections in one or both of the superhard cutting table and the substrate; (ii) positioning the metal or alloy layer to surround the join between the cutting table and the substrate; (iii) forming the metal or alloy layer so as to follow the profile of the or each depression and/or projection that is in the superhard cutting table or in the substrate or in both so as to form an interference fit between the metal or alloy layer and the superhard cutting table or the substrate or both. Optionally there is an additional step comprising: (iv) bonding the metal or alloy layer to a tool body so as to secure the cutting table and substrate relative to the tool body.

DETAILED DESCRIPTION

The metal or alloy layer is located adjacent to second surfaces of the cutting table and the substrate so as to surround the join between the cutting table and the substrate. When we say that the metal or alloy layer is located adjacent to second surfaces of the cutting table and the substrate we include the case that it is in direct contact with these second surfaces. We also include the case where there is an intermediate member separating the metal or alloy layer from the second surfaces of the cutting table and the substrate.

The metal or alloy layer used in some embodiments is generally a discrete part that is provided separately from the cutting table and the substrate and then positioned around the joined between those parts and formed (e.g. CIPed) to follow the profile of one or both of those parts. To this end, the metal or alloy layer may be a self-supporting layer In certain embodiments, the metal or alloy layer; and the one or more of the second surface(s) of the cutting table and/or substrate are each provided with depressions therein and/or projections therefrom, which depressions and/or projections co-operate with each other. Optionally the co-operating shapes of the metal or alloy layer and the cutting table and/or substrate provide an interference or friction fit with each other.

The co-operating shapes of the metal or alloy layer and the one or more surfaces of the cutting table and/or the substrate in which it is in contact substantially prevent relative movement therebetween. By this we mean relative movement in any direction relative to each other, e.g. relative rotation, relative lateral movement, or relative movement towards or away from each other away from their surface of contact.

For some embodiments the second surfaces of both the cutting table and the substrate are shaped to co-operate with the metal or alloy layer, e.g. containing depressions therein or projections therefrom. This is advantageous since it allows an interference fit to result between the metal or alloy layer and both of the cutting table and the substrate. A consequence of this is that there is specific securement of the metal or alloy layer to both parts on either side of the join between the cutting table and the substrate. However, even if there is only co-operating shaping between one of the cutting table and the substrate with the metal or alloy layer, the metal or alloy layer may still, by its own integrity, maintain its location around the join between the cutting table and the substrate, thus being in an appropriate position to protect the join, as described in more detail later.

The co-operating shapes of the metal or alloy layer and the one or more surfaces of the cutting table and/or the substrate in which it is in contact substantially prevent relative movement therebetween. To this end, the two parts may for example, have co-operating formations on their surfaces, for example depressions and/or upstanding projections on their surfaces. For example the parts may have co-operatingly shaped depressions, upstanding-dimples or nipples, grooves, ridges, cross-shaped depressions or ridges, one or more angled grooves, i.e. grooves at an angle to the circumferential direction, helical screw thread type projections or grooves, or the like. Such formations extending from the surfaces may be convex or concave in shape, or a combination thereof.

The superhard cutting table may, as a specific example, be substantially disc-shaped. The substrate may be substantially cylindrical, and may be of substantially the same diameter as a disc shaped cutting table and/or may be coaxial therewith.

The second surfaces of the cutting table and/or the substrate may be side or edge surfaces. For example, for a disc-shape cutting table and a cylindrical substrate the second surfaces may be the curved sides of those parts.

Any suitable superhard material may be used for the super-hard cutting element. As examples, there may be mentioned polycrystalline diamond and cubic boron nitride (cBN).

Where the superhard cutting table comprises PCD, any catalyst/solvent present may comprise, for example, cobalt, nickel, iron, manganese or an alloy containing one or more such metals. Where the superhard cutting table comprises cBN, the catalyst/solvent may comprise, for example, aluminium, alkali metals, cobalt, nickel, tungsten or the like.

Any suitable material may be used for the substrate. In some embodiments it is a material that is readily bonded by brazing, soldering or welding. To this end, the substrate material may comprise a metal, for example it may be a cemented metal carbide such as tungsten carbide. The cemented metal carbide substrate may contain residue catalyst material such as cobalt or the like from manufacture of the carbide substrate.

The metal or alloy layer may be applied around the join between the superhard cutting table and the substrate by any suitable method. It may be any suitable configuration. The metal or alloy layer may be formed against side surfaces of the superhard cutting table and substrate by pressing. The pressing may be achieved by an externally applied pressing force or by an internal drawing force. A number of methods may be mentioned as suitable for pressing the metal or alloy layer against the cutting table and/or substrate. These include isostatic pressing, mechanical deep drawing in a flexible mould, metal spinning or shrink fitting. In general shrink fitting processes which are usually achieved by heating or cooling one component before assembly and allowing that component to return to the ambient temperature after assembly apply considerable stresses to the underlying component, but such stresses may be minimised if shrink fitting is used in some embodiments where the metal or alloy layer is chosen to be relatively thin compared to the substrate or cutting table onto which it is shrunk. In some embodiments we have found that a convenient pressing technique is isostatic pressing, e.g. CIP, (cold isostatically pressing) or HIP (hot isostatic pressing) against the superhard cutting table and substrate. Such pressing methods result in the metal or alloy layer following the profile of the side surfaces of the superhard cutting table and substrate. Where the cutting table and/or substrate includes depressions or projections, for example grooves, including undercut grooves, the metal or alloy layer deforms, under the pressing process to follow that depressed, projecting, or grooved surface. In this instance, the metal or alloy layer after deformation substantially retains its original thickness in the deformed area, merely deforming to follow the cutting table profile. Similarly the metal or alloy layer may be a layer that prior to application to the cutting table is substantially uniform in thickness, and after application to the cutting table, e.g. by a pressing method which deforms it to follow the profiled of the cutting table and substrate, remains of substantially uniform thickness after the pressing process, the layer merely changing its profile to follow the profile of the cutting table and substrate.

In some embodiments where the substrate and or superhard cutting table include depressions and/or projections, the step of forming the metal or alloy layer causes not only the surface of the metal or alloy layer that is facing the underlying superhard cutting table and/or substrate, but also the opposed surface of the metal or alloy layer, to follow the profile of the or each depression and/or projection that is in the superhard cutting table or in the substrate or in both.

The co-operatingly shaped parts of the metal layer and the or each of the substrate and the cutting table may exert no or a small force on each other. There is no significant force between the parts as would be the case in a typical shrink fit embodiment in which the thickness of a shrink fit member is a considerable percentage (for example 30-90%) of the thickness of the part onto which it is to be shrunk.

Where the metal or alloy layer surrounds the join between the substrate and the cutting table the metal or alloy layer may form a closed loop around the join, for example for a cylindrical substrate and cutting table the metal or alloy layer may similarly be cylindrical in shape, and this may be a cylinder that is open ended or closed, and if closed typically closed at one end for easy application.

As another possibility for applying the metal or alloy layer around the join between the cutting table and the substrate, the metal or alloy layer may be formed in-situ. For example it may be formed in-situ using a powder forming process in a mould, for example powder metallurgy, the mould being such that the in-situ formed metal or alloy layer is co-operatingly shaped to fit against cutting table and substrate so as to follow the shape thereof, including for example following the profile of any depressions or projections therein.

Any suitable material may be used for the metal or alloy layer. As examples there may be mentioned iron, alloys with corrosion resistance e.g. Fe—Ni, steel e.g. annealed mild steel, or steel alloys. As other examples there may be mentioned Nb, Mo, Ta, rare earth super-alloys, Hastelloy™ super-alloys, and hardened steel. One factor in deciding on the choice of metal or alloy layer is the ductility and strength of the material; sufficient ductility and strength to withstand metal forming is advantageous for applications where the metal or alloy layer is deformed, e.g. where the metal or alloy layer is in the form of layer which is pressed, for example CIPed, so as to follow the profile of a cutting table containing depressions or projections. Another factor for deciding on the metal for the metal or alloy layer for some embodiments is ease of joining to a tool body, e.g. brazeability.

According to one embodiment, the cutting table may be substantially disc-shaped, and the substrate substantially cylindrical, and the metal or alloy layer may provide a hollow cylindrical shape that surrounds and is in contact with the curved side surface of the disc-shaped superhard cutting table and the curved side surface of the cylindrical substrate so as to surround the join between the cutting table and the substrate. In one embodiment the metal or alloy layer is in the form of a sleeve that surrounds the cutting table/substrate join. In another embodiment the metal or alloy layer is in the form of a cup that has been drawn around the cutting element and substrate. Such a cup may be located and installed, for example, by positioning it so that the base of the cup seats against the base of the cylindrical substrate, then drawing the cup up around the substrate and cutting table so that the sides of the cup extend along the curved side surfaces of the substrate and along at least part of the curved side surfaces of a disc-shaped cutting table. The cup may be located and installed in another example by positioning it so that the base of the cup seats against the top of the cutting table, and then drawing it down around the cutting table and substrate so that the sides of the cup extend along the curved side surfaces of the disc-shaped cutting table. and at least part way along at least part of the curved side surfaces of the substrate. Where reference is made to base and top, up and down, these are relative terms and assume an arbitrary orientation with the substrate at the bottom and the cutting table on top of it. In operation the substrate and cutting table may be inverted, or at any angle thereto.

The metal or alloy layer may be any suitable thickness appropriate to convenient forming ability and its thermal and chemical shielding properties both of which may depend on its composition. A typical minimum thickness for the metal or alloy layer is 0.01 mm, 0.03 mm, 0.05 mm, or 0.1 mm or 0.15 mm, and a typical maximum thickness for the metal or alloy layer is 0.6 mm, 0.5 mm, 0.4 mm or 0.3 mm. In some embodiments the metal or alloy layer may be substantially thicker, for example 6 mm thick, or 4 mm, or 2 mm, or 1 mm, or 0.8 mm thick. Typically, the metal or alloy layer may be 0.5-0.25 mm thick, for example about 0.2 mm thick.

The ratio of the thickness of the metal or alloy layer to the dimension of the cutting table and/or substrate to which it is adjacent, measured in the direction of the thickness of the metal or alloy layer is at most 1:10, or in some embodiments at most 1:15, or at most 1:20, or at most 1:40. Typically the cutting table and substrate are solid cylindrical in shape and the metal or alloy layer a hollow cylindrical shape surrounding it. In this case the thickness of the metal or alloy layer is measured as the thickness of the hollow cylindrical metal or alloy cylinder wall, and the dimension of the cutting table and/or s substrate to which it is adjacent, measured in the direction of the thickness of the metal or alloy layer is the diameter of the cutting table and/or substrate.

The bonding of the superhard cutting table to the substrate may be by brazing, soldering or welding or adhesion, as examples. The substrate may comprise a cemented metal carbide, for example tungsten carbide.

In some embodiments, the cutting table and/or substrate comprise a surface that includes one or more depressions therein and/or projections therefrom, and at least part of the metal or alloy layer is formed (for example pressed) against at least part of a surface of the cutting table and/or substrate. Generally the metal or alloy layer is formed (e.g. pressed) into direct contact with the cutting table and/or substrate, but it is also possible for there to be an intervening layer between the metal or alloy layer and the cutting table and/or substrate.

The embodiments described achieve a structure in which the metal or alloy layer is mechanically bonded to the substrate and/or to the cutting table in such a manner as to protect the join between the first surfaces of the superhard cutting table and the substrate. Protection may be protection from external heat, and/or protection from external chemical attack for example. This protection applies to any join between the super-hard cutting table and the substrate. It is particularly advantageous where there is a chemical bond between the superhard cutting table and the substrate, e.g. a brazed bond as is known in the art, which needs to be protected. The external heat or external chemical attack from which protection may be provided may be, for example, brazing heat and chemical braze material, applied to secure the cutting element to a tool body, i.e. in a cutting element fitment brazing step. The metal or alloy layer mechanically bonded to the substrate and/or to the cutting table in this way so as to protect the join between the substrate and cutting table, also provides a convenient means of attachment to a tool body. Thus, in one embodiment there is the additional step of bonding the metal or alloy layer to a tool body, thus securing the super-hard cutting table and substrate to the tool body. This may be achieved, for example, by brazing or soldering or welding. In this case the metal or alloy layer forms a convenient intermediate member to form a brazed or similar joint, while simultaneously protecting the join between the cutting table and the substrate of the cutting element from the fitment brazing process.

In one embodiment where the substrate is substantially cylindrical and the super-hard cutting table is substantially disc-shaped, the method comprises forming annular depressions and/or projections, e.g. annular grooves, in the curved surface of the substantially cylindrical substrate or in the curved surface of the disc-shaped super-hard cutting table, or both. Where the metal or alloy layer is drawn over the sides of the substrate and/or super-hard cutting table, the annular depressions and/or projections may be formed in the substrate and/or super-hard cutting table prior to the metal drawing step.

In some embodiments the super-hard cutting table comprises PCD or cBN which has been at least partially depleted of catalyst/solvent, and in some embodiments substantially completely depleted of catalyst/solvent. This catalyst/solvent depletion may be achieved, for example, by acid leaching or the like. A join between a super-hard cutting table that has been partially or completely leached of catalyst solvent may be particularly vulnerable to attack, and the use of a metal or alloy layer as described herein to protect the join particularly advantageous. The metal or alloy layer also conveniently provides a convenient means to attach the substrate and the leached PCD layer within a tool body. The metal or alloy layer may be mechanically secured to the leached PCD layer, which layer might be otherwise difficult to bond to a surrounding tool body. The metal or alloy layer is itself easily bonded, e.g. brazed, to a tool body.

BRIEF DESCRIPTION OF DRAWINGS

Some embodiments will now be described by way f example only and with reference to the accompanying drawings, wherein:

Referring to the drawings, FIG. 1 is a perspective view of a cutting element according to one embodiment, with a metal or alloy layer protecting the join between the component parts of the cutting element. In this embodiment a cutting element 21 comprises a disc shaped PCD cutting table 23 that is directly secured to a cylindrical cemented tungsten carbide substrate 27. The PCD cutting table 23 and substrate 27 may be formed together in a HPHT environment in a canister, for example by putting particulate diamond and a catalyst in a canister above a preformed cemented carbide substrate, and subjecting the canister to HPHT conditions, or may be, or formed together and then separated, treated in some way e.g. leached to remove catalyst, and re-secured, or may be formed separately and then secured together. Where securement is required, this may be for example by brazing, e.g. microwave brazing or HPHT brazing. Other suitable securement means may also be employed, e.g. adhesive or similar bonding means.

Figure 1:
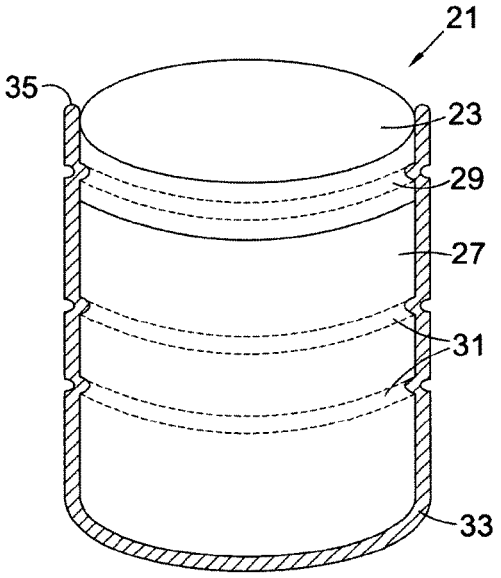
FIG. 1 is a perspective view of a cutting element according to one embodiment, with a metal or alloy layer protecting the join between the component parts of the cutting element.

The PCD disc 23 has an annular groove 29 extending around its edge surface, and the cylindrical cemented tungsten carbide substrate 27 has two similar annular grooves 31 extending around its curved surface, longitudinally spaced from each other. A Nb metal or alloy layer 33 which is cup shaped, and is referred to hereinafter as the metal cup 33, has been drawn over the cutting element 21, so that the base of the metal cup 33 sits against the base of the cutting element and the sides of the metal cup 33 sit against the sides of the substrate 27 and PCD disc 23. The sides of the metal cup 33 extend up the entire length of the sides of substrate 27 and sides of PCD disc 23, and extend slightly above the exposed cutting surface of the PCD disc 23, as indicated by reference numeral 35. The metal cup 33 has been cold isostatically pressed (CIPed) against the underlying substrate 27 and PCD disc 23, so that the metal cup 33 follows the profile of the underlying substrate 27 and cutting table 23, and in particular follows the grooved profile of groove 29 in the PCD cutting table 23 and the grooves 31 in the carbide substrate 27. There is no chemical bond between the cup 33 and the tungsten carbide substrate 27 or between the cup 33 and the cutting table 23, but there is a mechanical bond to both created by the interference or friction fit generated by the co-operating depressions (grooves) on the metal cup 33 and the grooves 31 and 29 respectively on the carbide substrate 27 and PCD cutting table 23. The metal cup layer 33 follows the profile of the grooves 29 and 31, dipping into the grooves; it therefore has an outwardly facing surface that also presents grooves. Therefore both the inner and outer surfaces of the metal or alloy layer of metal cup 33 follow grooved profiles 29 and 31 in the cutting table 23 and carbide substrate 27 respectively. So it is evident when viewing the part that the metal cup 33 has followed the profile of the underlying grooved cutting table 23 and substrate 27. There is no need to take a cross section through the part to ascertain this. The metal cup thickness remains substantially unchanged after the CIPing process; it simply deforms to follow the underlying profile. Thus the thickness of the metal or alloy layer 33 is substantially uniform over its area, both before the pressing process, and also after the pressing process. The thickness of the metal or alloy layer is 0.2 mm.

In an alternative (not illustrated) to the embodiment shown in FIG. 1, the pair of annular grooves 31 could be replaced by a single annular groove 31, optionally the upper of the two annular grooves illustrated. This alternative embodiment would be sufficient to protect the PCD cutting table/substrate join.

In use in a rotary drill bit or the like, the cutting element is typically bonded by brazing into sockets in drill bit blades. We shall refer to this step as "fitment brazing". The metal cup 33 covers the join line between the PCD cutting table 23 and the cemented carbide substrate 27, and hence during the fitment brazing the join line between the PCD cutting table 23 and the cemented carbide substrate is shielded by the metal cup 33 from both the heat of the fitment braze, and from chemical ingress which might result from the fitment brazing process. Any extension 35 of the cup 33 above the cutting surface of the PCD disc 23 is readily eroded away during operation of the drill bit, allowing tolerance in the process of drawing the metal cup 33.

Figure 2:
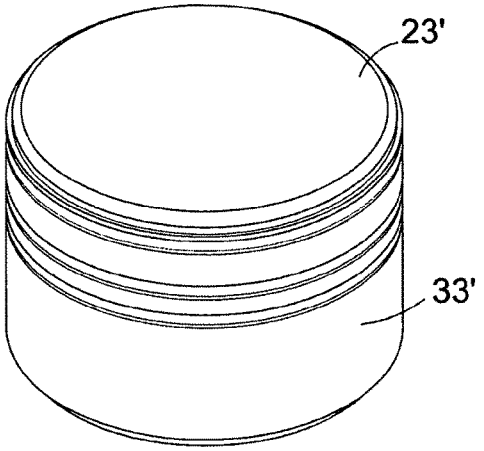
FIG. 2 is a perspective view of a cutting element according to a modified embodiment.
Figure 3:
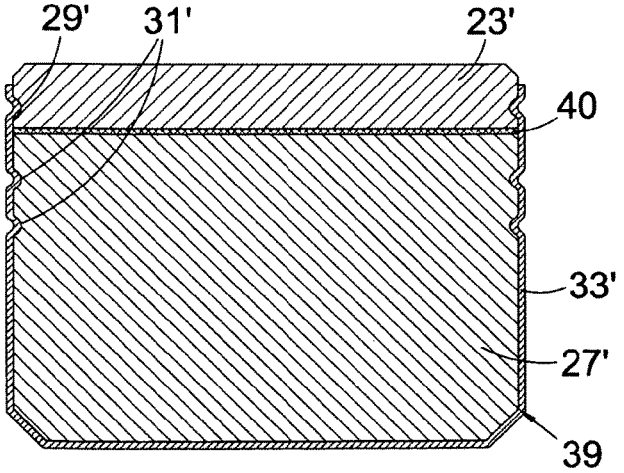
FIG. 3 is a side sectional view of the cutting elements of FIG. 2 taken along the line C-C of FIG. 4.
Figure 4:
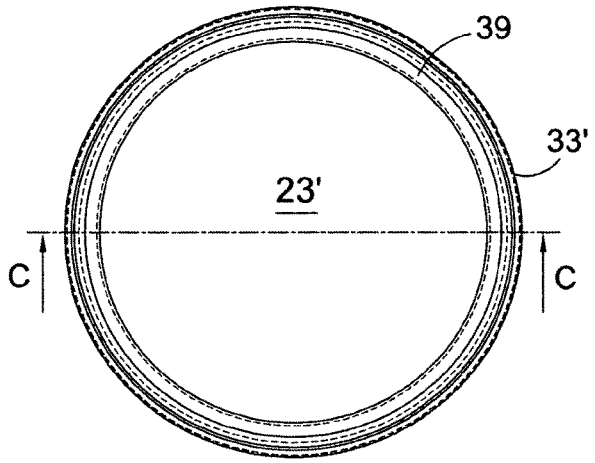
FIG. 4 is a plan view, showing hidden detail, of the cutting element of FIGS. 2 and 3.
Figure 5:
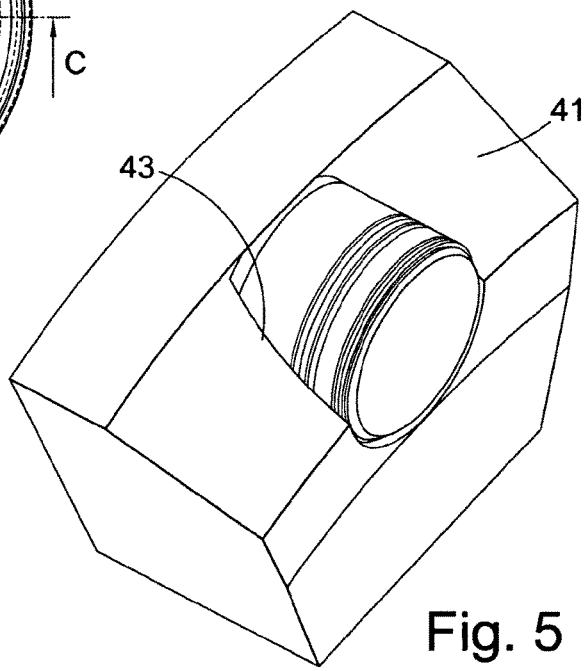
FIG. 5 is a perspective view and FIG. 6 a side sectional view showing securement of the cutting element of FIGS. 2-4 into a bit body.
Figure 6:
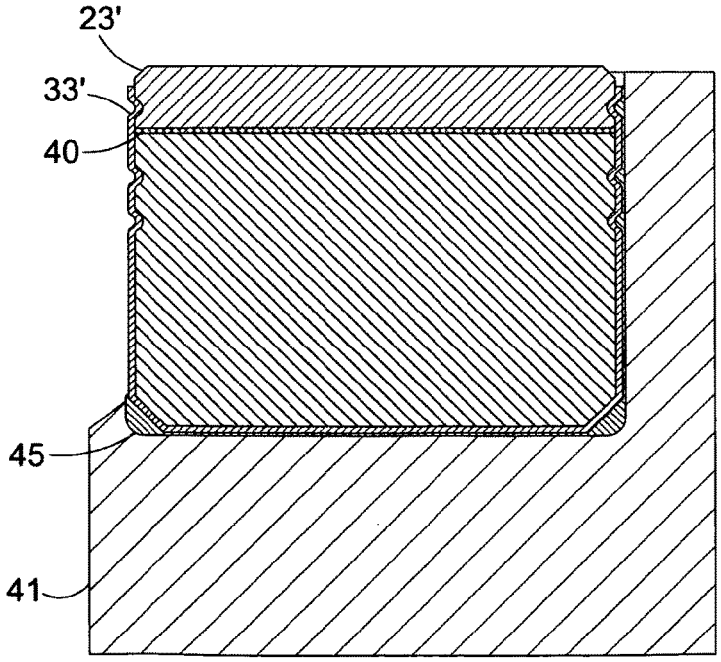

FIGS. 2-4 show an embodiment similar to that shown in FIG. 1, but with some slight modifications. In FIGS. 2-4, similar parts to those shown in FIG. 1 are given the same reference numerals as used in FIG. 1, but with an additional prime ' suffix. The modifications in FIGS. 2-4 are that the metal cup 33' does not extend above the upper surface of the PCD cutting table 23', and the cylindrical substrate 27' is chamfered at its bottom edge (distant from the cutting table) as indicated by reference numeral 39. In addition in the embodiment of FIGS. 2-4 the PCD cutting table 23' and the carbide substrate 27' are secured to each other by a braze joint 40. It is this braze joint in particular that is protected by the metal or alloy layer 33' in subsequent fitment brazing of the cutting element 21' into a bit body FIGS. 5 and 6 illustrate securement of the cutting element of FIGS. 2-4 by fitment brazing into a bit body 41. As seen in both figures the bit body comprises sockets 43 (only one is illustrated) into which the cutting elements 21' are inserted. They are an approximate fit for the cutting elements, but not an interference fit. In order to secure the cutting elements 21' into these pockets 43 a braze layer 45 is introduced between the cutting elements 21 and the sockets 43, and heat applied to effect fitment brazing. Particular strength is provided to the braze connection by the chamfered regions 39 of the cutting elements 31 providing an annular pocket for the braze layer 45 to form a secure braze connection. During this bit fitment brazing operation the original brazed joint 40 between the PCD cutting table 23' and the substrate 27' is shielded both from the heat from the fitment brazing operation, and also any chemical attack from the fitment brazing material itself. The mechanically secured Nb metal or alloy layer 33' also provides a convenient easy material for braze securement to the bit body. It may be chosen to be a material more readily brazed to the bit body material than either or both of the PCD cutting table 23' or the carbide substrate 27'. Being mechanically secured to both parts the metal or alloy layer 33' acts as an intermediate member to connect both parts (the PCD cutting table 23' and the carbide substrate 27') to the bit body 41. It simultaneously acts as a shield to protect the cutting element braze layer 40 from thermal and chemical degradation which might otherwise affect it during the process when it is brazed to the bit body 41.

Figure 7A:
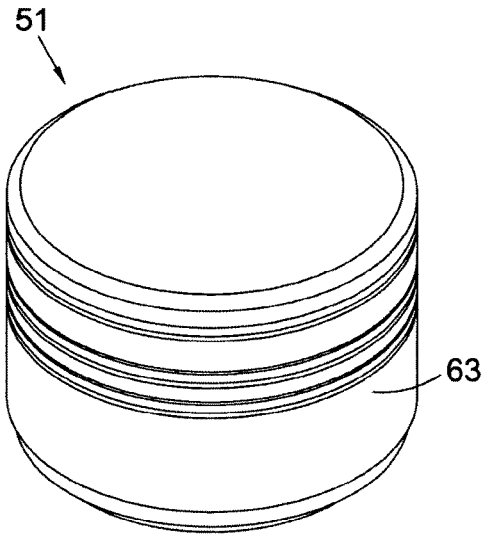
FIGS. 7*a*, 7*b*, and 8 are respectively a perspective view, a perspective view partly cut away and a side sectional view of another embodiment of cutting element.
Figure 7B:
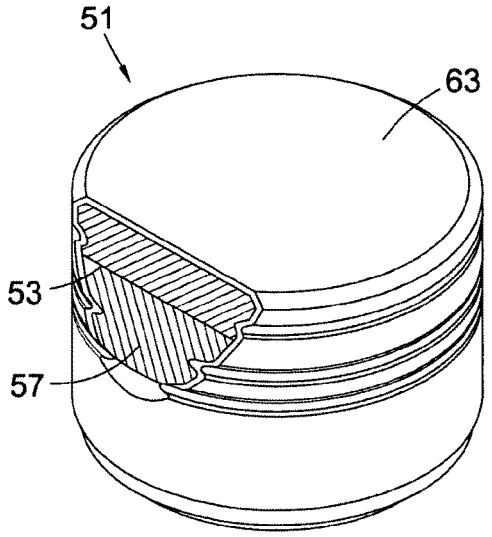
Figure 8:
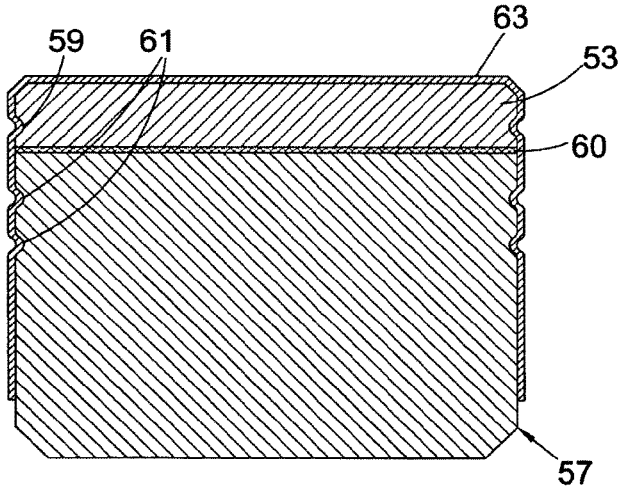

FIGS. 7*a*, 7*b*, and 8 show another embodiment of cutting element. In this embodiment a cutting element 51 comprises a disc shaped PCD cutting table 53 that is secured to a cylindrical cemented tungsten carbide substrate 57 via a brazed layer 60. The PCD disc 53 has an annular groove 59 extending around its edge surface, and the cylindrical cemented tungsten carbide substrate 57 has two similar annular grooves 61 extending around its curved surface, longitudinally spaced from each other. A Nb metal or alloy layer in the shape of a cup 63 has been drawn over the cutting element 21, so that the base of the metal cup 53 sits against the top of the cutting element, over the top (in the orientation illustrated) of the PCD disc 53 and the sides of the metal cup 63 sit against the sides of the PCD disc 53 and extend part way down the sides of the substrate 57. The metal surface covering the cutting surface will not adversely affect the wear/cutting performance of the product since it will simply wear off in use exposing the cutting surface below. As in the previous embodiments the metal cup 53 has been cold isostatically pressed (CIPed) against the underlying substrate 57 and PCD disc 53, so that the metal cup 63 follows the profile of the underlying substrate 57 and disc 53, and in particular follows the grooved profile of groove 59 in the PCD cutting table 53 and the grooves 61 in the carbide substrate 57. As before there is no chemical bond between the cup 63 and the tungsten carbide substrate 57 or between the cup 63 and the PCD disc 53, but there is a mechanical bond to both created by the interference or friction fit generated by the co-operating depressions (grooves) on the metal cup 63 and on the carbide substrate 57 and PCD cutting table 53. This embodiment can be secured in sockets in a bit body as shown in FIGS. 5 and 6 in the same manner as that described for the embodiment of FIGS. 1-4.

The invention claimed is:

1. A composite part comprising:

a super-hard cutting table;

a substrate; and a metal or alloy layer;

the superhard cutting table having a first surface that is joined to a first surface of the substrate and the metal or alloy layer being located adjacent to second surfaces of the cutting table and the substrate so as to surround the join between the first surfaces of the cutting table and the substrate; wherein: the metal or alloy layer and one or both of the second surfaces of the cutting table and substrate to which it is adjacent are provided with depressions therein and/or projections therefrom, which depressions and/or projections co-operate with each other substantially to prevent relative movement therebetween, the surface of the metal or alloy layer closest to the substrate and the cutting table and also the opposing surface of the metal or alloy layer having a profile having depressions and/or projections following the profile of the depressions and/or projections in the cutting table and/or substrate.

2. A composite part according to claim 1, wherein the ratio of the thickness of the metal or alloy layer to the dimension of the cutting table and/or substrate to which it is adjacent, measured in the direction of the thickness of the metal or alloy layer is at most 1:10.

3. A composite part according to claim 1, wherein the thickness of the metal or alloy layer is at most 6 mm.

4. A composite part according to claim 1, wherein the super-hard cutting element comprises polycrystalline diamond (PCD).

5. A composite part according to claim 1, wherein the substrate comprises a cemented carbide.

6. A composite part according to claim 5, wherein the substrate comprises a cemented metal carbide.

7. A composite part according to claim 1, wherein the cutting table is substantially disc-shaped, and the substrate is substantially cylindrical, and the metal or alloy layer provides a hollow cylindrical shape that surrounds and is adjacent to at least part of the curved side surface of the disc-shaped superhard cutting table and at least part of the curved side surface of the cylindrical substrate so as to surround the join between the cutting table and the substrate.

8. A composite part according to claim 7, wherein the metal or alloy layer is in the shape of a cup that has been drawn around the cutting element, so that the base of the cup seats against the base of the substrate, and the sides of the cup extend along the curved side surfaces of the cylindrical substrate and at least part of the curved sides of the disc-shaped cutting table.

9. A composite part according to claim 7, wherein the metal or alloy layer is in the shape of a cup that has been drawn around the cutting element, so that the base of the cup seats against the top of the cutting element, and the sides of the cup extend along the curved side surfaces of the disc-shaped cutting table and at least part of the curved sides of the cylindrical substrate.

10. A method of protecting a join between a super-hard cutting table and a substrate using a metal or alloy layer, the method comprising: (i) forming one or more depressions and/or projections in one or both of the superhard cutting table and the substrate; (ii) positioning the metal or alloy layer to surround the join between the cutting table and the substrate; (iii) forming the metal or alloy layer so as to follow the profile of the or each depression and/or projection that is in the superhard cutting table or in the substrate or in both so as to form an interference fit between the metal or alloy layer and the superhard cutting table or the substrate or both; and wherein the metal or alloy layer and one or both of the second surfaces of the cutting table and substrate to which it is adjacent are provided with depressions therein and/or projections therefrom, which depressions and/or projections co-operate with each other substantially to prevent relative movement therebetween, the surface of the metal or alloy layer closest to the substrate and the cutting table and also the opposing surface of the metal or alloy layer having a profile having depressions and/or projections following the profile of the depressions and/or projections in the cutting table and/or substrate.

11. A method according to claim 10, wherein the step of forming the metal or alloy layer so as to follow the profile of the or each depression and/or projection that is in the superhard cutting table or in the substrate or in both is carried out by cold isostatic pressing.

12. A method according to claim 10, wherein the step of forming the metal or alloy layer causes not only the surface of the metal or alloy layer that is facing the underlying superhard cutting table and/or substrate, but also the opposed surface of the metal or alloy layer, to follow the profile of the or each depression and/or projection that is in the superhard cutting table or in the substrate or in both.

13. A method according to claim 10, comprising the additional step, after the forming of the metal or alloy step, of bonding the metal or alloy layer to a tool body, thereby securing the cutting table and substrate relative to the tool body.

14. A method according to claim 10, wherein the superhard cutting table is substantially disc-shaped, and the substrate is substantially cylindrical.

15. A method according to claim 14, wherein the metal or alloy layer is substantially cup shaped and is located so that the base of the cup is seated against either the base of the cylindrical substrate or the top of the cutting table, and the method comprises drawing the sides of the metal cup over the curved sides of the cylindrical substrate and the curved edge of the disc shaped super-hard cutting element to cover the join between the superhard cutting element and the substrate.

16. A method according to claim 14, wherein the step of forming one or more depressions and/or projections in one or both of the superhard cutting table and the substrate comprises forming annular grooves in the curved surface of the substrate or in the curved surface of the superhard cutting table, or both.

* * * * *